US008587576B2

(12) United States Patent
Park et al.

(10) Patent No.: US 8,587,576 B2
(45) Date of Patent: Nov. 19, 2013

(54) ORGANIC LIGHT EMITTING DISPLAY

(75) Inventors: Dong-Wook Park, Yongin (KR); Won-Kyu Kwak, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 326 days.

(21) Appl. No.: 12/820,911

(22) Filed: Jun. 22, 2010

(65) Prior Publication Data

US 2011/0084946 A1 Apr. 14, 2011

(30) Foreign Application Priority Data

Oct. 13, 2009 (KR) ..... 10-2009-0097161

(51) Int. Cl.
*G09G 5/00* (2006.01)

(52) U.S. Cl.
USPC ..... 345/211; 345/76

(58) Field of Classification Search
USPC ..... 345/76, 211
See application file for complete search history.

(56) References Cited

U.S. PATENT DOCUMENTS

| | | | | |
|---|---|---|---|---|
| 7,646,381 | B2 * | 1/2010 | Komatsu et al. | 345/204 |
| 2001/0022572 | A1 * | 9/2001 | Murade | 345/98 |
| 2006/0060850 | A1 * | 3/2006 | Kwak et al. | 257/59 |
| 2006/0110919 | A1 * | 5/2006 | Moriya et al. | 438/675 |
| 2007/0001711 | A1 * | 1/2007 | Kwak | 324/770 |
| 2007/0268206 | A1 * | 11/2007 | Kinoshita et al. | 345/30 |
| 2008/0054798 | A1 | 3/2008 | Jeong et al. | |
| 2008/0068312 | A1 * | 3/2008 | Kim | 345/84 |
| 2008/0272992 | A1 * | 11/2008 | Kwak | 345/76 |
| 2010/0062553 | A1 * | 3/2010 | Sung et al. | 438/28 |

FOREIGN PATENT DOCUMENTS

| | | | |
|---|---|---|---|
| CN | 1780530 | A | 5/2006 |
| CN | 101118724 | A | 2/2008 |
| JP | 11-260266 | | 9/1999 |
| JP | 2003-287767 | | 10/2003 |
| JP | 2005-208449 | A | 8/2005 |
| JP | 2007-304394 | | 11/2007 |
| JP | 2008-033253 | | 2/2008 |

(Continued)

OTHER PUBLICATIONS

Extended European Search report dated Jan. 21, 2011, issued in corresponding European patent application No. 10251592.1, 13 pps.

(Continued)

*Primary Examiner* — Latanya Bibbins
(74) *Attorney, Agent, or Firm* — Christie, Parker & Hale, LLP

(57) ABSTRACT

An organic light emitting display includes a display unit at the center of a panel and including a plurality of pixels at crossing regions of scan lines and data lines, a scan driver for supplying scan signals to the scan lines and on the panel, a pad unit on the panel and for supplying driving powers and control signals to the display unit and the scan driver, the pad unit including first and second pads for supplying a gate high level voltage to the scan driver and third and fourth pads and for supplying a gate low level voltage to the scan driver, a first power source supply line surrounding the display unit and coupling the first pad to the second pad via the scan driver, and a second power source supply line surrounding the display unit and coupling the third pad to the fourth pad via the scan driver.

13 Claims, 4 Drawing Sheets

(56) References Cited

FOREIGN PATENT DOCUMENTS

| | | | |
|---|---|---|---|
| KR | 1020040103870 | A | 12/2004 |
| KR | 1020050122698 | A | 12/2005 |
| KR | 10-0583138 | | 5/2006 |
| KR | 1020060047607 | A | 5/2006 |
| KR | 10-2006-0062605 | | 6/2006 |
| KR | 10-2007-0078141 | | 7/2007 |

OTHER PUBLICATIONS

KIPO Office action for Korean priority Patent Application No. 10-2009-0097161, dated Apr. 7, 2011, 2 pages.
SIPO Office action dated Dec. 5, 2012 for corresponding CN application No. 201010249293.9 (7 pages).
JPO Office action dated Mar. 19, 2013, for corresponding Japanese Patent application 2010-049713, (2 pages).

* cited by examiner

ORGANIC LIGHT EMITTING DISPLAY

CROSS-REFERENCE TO RELATED APPLICATION

This application claims priority to and the benefit of Korean Patent Application No. 10-2009-0097161, filed on Oct. 13, 2009, in the Korean Intellectual Property Office, the entire content of which is incorporated herein by reference.

BACKGROUND

1. Field

An embodiment of the present invention relates to an organic light emitting display.

2. Description of Related Art

An organic light emitting display is a kind of a flat panel display (FPD) in which an organic compound may be used as a thin and light (or lightweight) light emitting material having high brightness and chromatic purity which may be driven with low power. Therefore, the organic light emitting display may be used for various displays such as a portable display.

The organic light emitting display may include a display unit (or pixel unit or display region) including a plurality of pixels formed at crossing regions of scan lines and data lines, a scan driver for supplying scan signals to the scan lines, and a data driver for supplying data signals to the data lines.

The display unit, the scan driver, and the data driver are commonly located on a panel of the organic light emitting display to receive driving powers and/or driving signals through a pad unit formed on one side of the panel.

For example, the display unit, the scan driver, and the data driver may be electrically coupled to a film on glass (FOG) or a flexible printed circuit board (FPCB) bonded on the panel through the pad unit to receive the driving powers and/or the driving signals from (or via) the FOG or the FPCB.

Pads for supplying each of the driving powers and the driving signals are commonly formed in the pad unit one by one. When the bonding process generates (or causes) pressure failure of a pad, the display unit, the scan driver, and the data driver that would otherwise receive the driving powers and the driving signals through the failed pad may operate erroneously.

In particular, pads for supplying a gate high level voltage VGH and a gate low level voltage VGL that are the driving powers of the scan driver are located at the edge of the pad unit so that pressure failure may be easily generated (or caused). In addition, the pressure areas of the pads may be designed to be reduced in order to reduce the dead space at the lower end (or lower portion) of the panel where the pad unit is formed. In this case, it may be difficult to stably supply the driving powers to the scan driver.

SUMMARY

An aspect of an embodiment of the present invention is directed toward an organic light emitting display capable of stably supplying driving powers for driving a scan driver.

An organic light emitting display according to an embodiment of the present invention includes a display unit at the center of a panel and including a plurality of pixels at crossing regions of scan lines and data lines, a scan driver for supplying scan signals to the scan lines and on the panel, a pad unit on the panel and for supplying driving powers and control signals to the display unit and the scan driver, the pad unit including first and second pads for supplying a gate high level voltage to the scan driver and third and fourth pads for supplying a gate low level voltage to the scan driver, a first power source supply line surrounding the display unit and coupling the first pad to the second pad via the scan driver, and a second power source supply line surrounding the display unit and coupling the third pad to the fourth pad via the scan driver.

The organic light emitting display may further include an emission control driver located on the panel to face the scan driver based on the display unit for supplying emission control signals to emission control lines extending in parallel with the scan lines.

The first power source supply line surrounding the display unit may couple the first pad to the second pad via the scan driver and the emission control driver, and the second power source supply line surrounding the display unit may couple the third pad to the fourth pad via the scan driver and the emission control driver.

The scan driver may be configured to generate high level voltages of the scan signals by utilizing the gate high level voltage and to generate low level voltages of the scan signals by utilizing the gate low level voltage, and the emission control driver may be configured to generate high level voltages of the emission control signals by utilizing the gate high level voltage and to generate low level voltages of the emission control signals by utilizing the gate low level voltage.

The scan driver may be located at a first edge of the panel and the emission control driver may be located on at second edge of the panel.

The pad unit may be located at a lower edge of the panel, and the first power source supply line and the second power source supply line may couple the scan driver and the emission control driver to each other through a region at an upper edge of the panel.

The organic light emitting display may further include a data driver between the display unit and the pad unit and for supplying data signals to the data lines.

The first pad and the second pad may receive a same gate high level voltage, and the third pad and the fourth pad may receive a same gate low level voltage.

The first pad and the second pad may be at different edges of the pad unit.

The third pad and the fourth pad may be at different edges of the pad unit.

The first power source supply line and the second power source supply line may be in the same layer as and composed of the same material as source and drain electrodes of transistors formed on the panel.

The first power source supply line and the second power source supply line may be in the same layer as and composed of the same material as gate electrodes of transistors formed on the panel.

A first portion of the first power source supply line and a first portion of the second power source supply line may be in the same layer as and composed of the same material as source and drain electrodes of transistors on the panel and a second portion of the first power source supply line and a second portion of the second power source line may be in the same layer as and composed of the same material as gate electrodes of transistors on the panel.

The scan driver may be located on a first side of the panel and the pad unit may be located on a second side of the panel.

According to embodiments of the present invention, the gate high level voltage and the gate low level voltage used as the driving powers of the scan driver may be stably supplied to the scan driver to reduce or prevent the erroneous operation of the scan driver.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
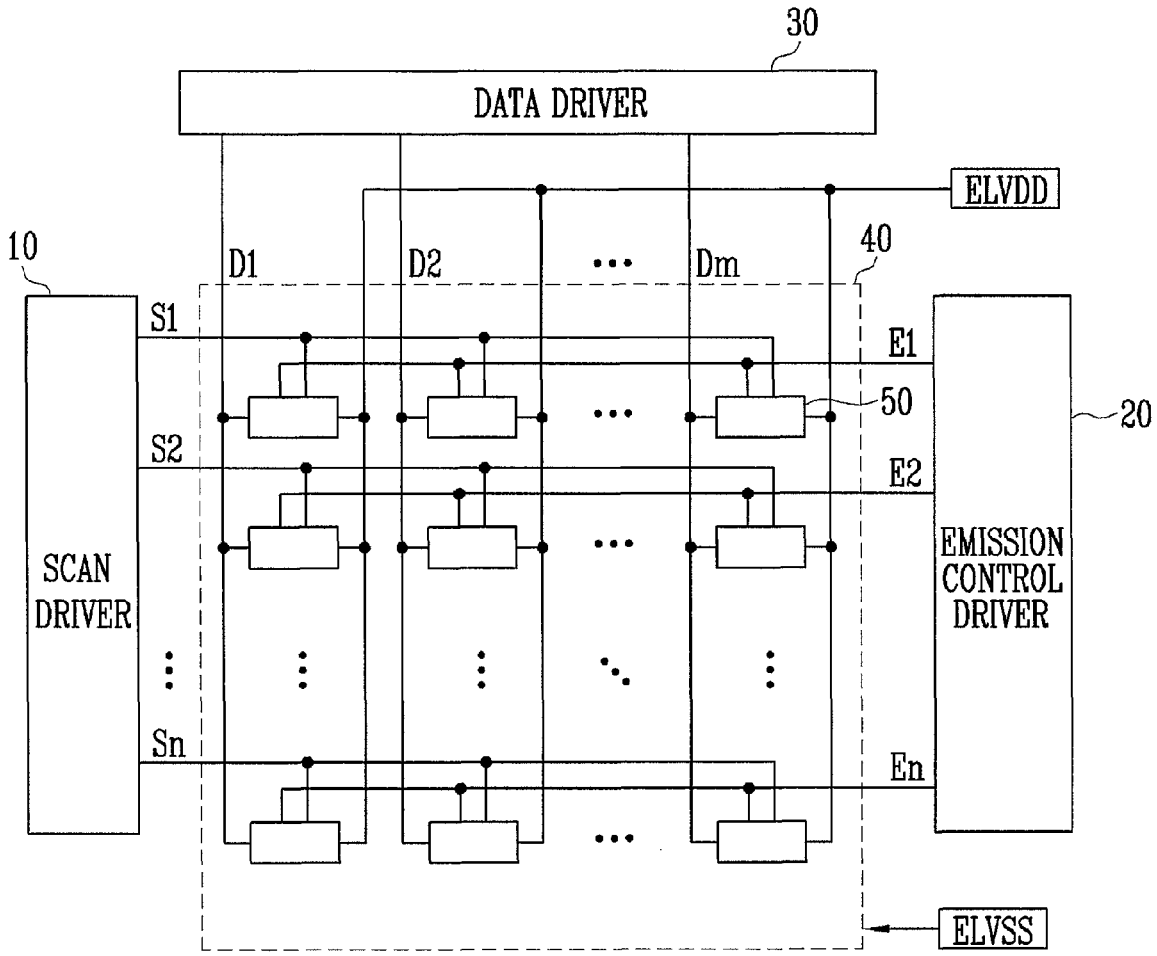
FIG. 1 is a block diagram illustrating an organic light emitting display according to one embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, an exemplary embodiment of the present invention will be described in more detail with reference to the accompanying drawings.

FIG. 1 is a block diagram illustrating one embodiment of an organic light emitting display.

Referring to FIG. 1, the organic light emitting display includes a scan driver 10, an emission control driver 20, a data driver 30, and a display unit 40.

The scan driver 10 generates scan signals to correspond to the driving powers and control signals supplied from the outside (e.g., an external source) and sequentially supplies the generated scan signals to scan lines S1 to Sn. Then, pixels 50 are selected by the scan signals to sequentially receive data signals.

The emission control driver 20 sequentially supplies emission control signals to emission control lines E1 to En arranged to run parallel with the scan lines S1 to Sn in accordance with the driving powers and control signals supplied from the outside. The emission control signals control the emission of the pixels 50.

The scan driver 10 and the emission control driver 20 may be mounted on a panel in the form of a chip or they may be built-in on the panel together with driving elements included in the display unit 40 to constitute a built-in circuit unit.

In FIG. 1, for example, the scan driver 10 and the emission control driver 20 are respectively at different (or opposite) sides (or edges) of the display unit and face each other with the display unit 40 interposed therebetween. However, the present invention is not limited to the above.

For example, the scan driver 10 and the emission control driver 20 may be formed at the same side (or edge) of the display unit 40.

In addition, in accordance with the structure of the pixels 50 included in other embodiments of the display unit 40, the emission control driver 20 may be omitted.

The data driver 30 generates data signals in accordance with the data and control signals supplied from the outside and supplies the generated data signals to the data lines D1 to Dm. The data signals supplied to the data lines D1 to Dm are supplied to the pixels 50 selected by the scan signals whenever the scan signals are supplied. Then, the pixels 50 charge (or store) voltages corresponding to (or in accordance with) the data signals.

The display unit 40 includes a plurality of pixels 50 located at crossing regions where the scan lines S1 to Sn and the emission control lines E1 to En cross with the data lines D1 to Dm.

The display unit 40 receives a first power from a first power source ELVDD that is a high potential (or high voltage) pixel power source and a second power from a second power source ELVSS that is a low potential (or low voltage) pixel power source from the outside. The first power and the second power are transmitted to the pixels 50. In addition, the display unit 40 may additionally receive an initialization power from an initialization power source Vinit or a reference voltage Vref in accordance with the structure of the pixels 50.

Then, the pixels 50 each emit light with a brightness corresponding to (or in accordance with) a driving current that flows from the first power source ELVDD to the second power source ELVSS in accordance with the data signals so that the pixels 50 display an image.

Figure 2:
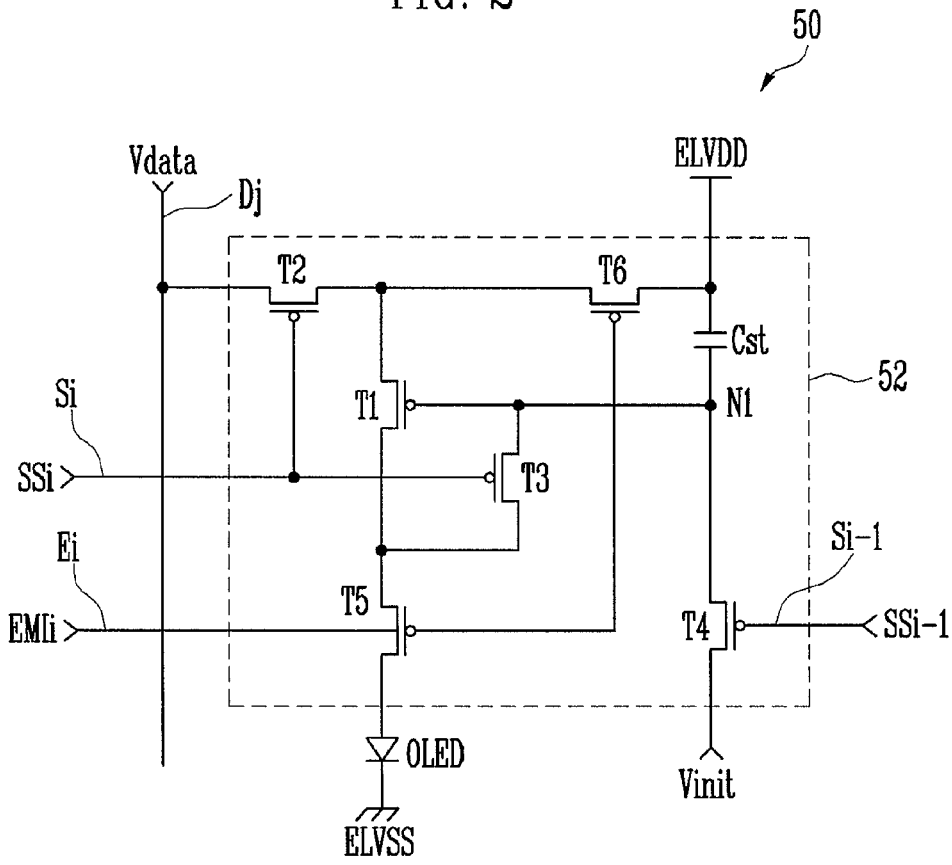
FIG. 2 is a circuit diagram illustrating an example of a pixel of the organic light emitting display of FIG. 1.

FIG. 2 is a circuit diagram illustrating one embodiment of the pixel of FIG. 1. For the sake of convenience FIG. 2 illustrates a pixel which compensates for an initialization voltage and a threshold voltage located in an ith (i is a natural number) row and a jth (j is a natural number) column. However, the present invention is not limited to the above. Embodiments of the present invention may include pixels having various alternative structures.

Referring to FIG. 2, the pixel 50 according to one embodiment includes a pixel circuit 52 having a plurality of transistors T1, T2, T3, T4, T5, and T6 and a storage capacitor Cst and an organic light emitting diode (OLED) that receives driving current from the pixel circuit 52.

The pixel circuit 52 initializes the voltage stored in the storage capacitor Cst when a previous scan signal SSi-1 is supplied from a previous scan line Si-1, charges the voltages corresponding to the data signal Vdata and the threshold voltage of the first transistor T1 when a current scan signal SSi is supplied from a current scan line Si, and supplies a driving current corresponding to the data signal Vdata to the OLED regardless of the threshold voltage of the transistor T1.

Although not shown in FIG. 1, each of the pixels 50 may be coupled to the previous scan line Si-1 as well as the current scan line Si and a $0^{th}$ scan line S0 for initializing the first row pixels 50 may be further arranged as the row previous to (or before) the first scan line S1. An initialization power source line for supplying the initialization power source Vinit to each of the pixels 50 may be further designed (or included) in the display unit 40.

In this embodiment, the pixel circuit 52 is coupled to the current scan line Si, the previous scan line Si-1, the emission control line Ei, the data line Dj, the first power source ELVDD, the initialization power source Vint, and an OLED and includes the first through sixth transistors T1, T2, T3, T4, T5, and T6 and the storage capacitor Cst.

The first transistor T1 is coupled between the first power source ELVDD and the OLED to control the driving current to correspond to (or in accordance with) the voltage applied to the gate electrode thereof.

To be specific, the first electrode (for example, the source electrode) of the first transistor T1 is coupled to the first power source ELVDD via the sixth transistor T6 and the second electrode (for example, the drain electrode) of the first transistor T1 is coupled to the OLED via the fifth transistor T5. The gate electrode of the first transistor T1 is coupled to a first node N1. The first transistor T1 controls the driving current supplied to the OLED to correspond to (or in accordance with) the voltage of the first node N1, that is, the voltage charged in the storage capacitor Cst.

The second transistor T2 is coupled between the data line Dj and the storage capacitor Cst and is turned on when the current scan signal SSi is supplied from the current scan line Si to transmit the data signal to the pixel 50.

In more detail, the first electrode of the second transistor T2 is coupled to the data line Dj and the second electrode of the second transistor T2 is coupled to the storage capacitor Cst via the first and third transistors T1 and T3. The gate electrode of the second transistor T2 is coupled to the current scan line Si. The second transistor T2 is turned on when the current scan signal SSi is supplied from the current scan line Si to transmit the data signal Vdata supplied from the data line Dj to the storage capacitor Cst via the first and third transistors T1 and T3.

The third transistor T3 is coupled between the gate electrode of the first transistor T1 and the second electrode (for example, the drain electrode) of the first transistor T1 to diode couple (or diode connect) the first transistor T1 to correspond to the voltage applied to the gate electrode thereof.

In more detail, the first electrode of the third transistor T3 is coupled to the second electrode of the first transistor T1, and the second electrode of the third transistor T3 is coupled to the gate electrode of the first transistor T1. The gate electrode of the third transistor T3 is coupled to the current scan line Si. The third transistor T3 is turned on when the current scan signal SSi is supplied from the current scan line Si to diode couple (or diode connect) the first transistor T1.

The fourth transistor T4 is coupled between the storage capacitor Cst and the initialization power source Vinit and is turned on by the previous scan signal SSi-1 to transmit the voltage of the initialization power source Vinit to the storage capacitor p Cst.

Unlike the first power source ELVDD and the second power source ELVSS, the initialization power source Vinit does not form a current path and supplies a constant voltage to a pixel circuit 52 that is coupled to the current scan line Si in a period before the current scan signal SSi is supplied (for example, in a period when the previous scan signal SSi-1 is supplied to the previous scan line Si-1). The initialization power source Vinit is set to have a lower voltage than the voltage of the data signal Vdata, that is, a lower voltage than the lowermost voltage of the data signal Vdata.

That is, when the fourth transistor T4 is turned on, the voltage of the first node N1 is initialized to a lower voltage than the voltage of the data signal Vdata so that the first transistor T1 is diode coupled in a forward direction in the writing period (e.g., a period in which the current scan signal SSi is applied) of the data signal Vdata so that the data signal Vdata is smoothly supplied to the first node N1.

In more detail, the first electrode of the fourth transistor T4 is coupled to the first node N1, and the second electrode of the fourth transistor T4 is coupled to the initialization power source Vinit. The gate electrode of the fourth transistor T4 is coupled to the previous scan line Si-1. The fourth transistor T4 is turned on when the previous scan signal SSi-1 is supplied from the previous scan line Si-1 to couple the initialization power source Vinit to the first node N1. Then, the voltage of the initialization power source Vinit is applied to the first node N1 so that the voltage of the first node N1 is initialized.

The fifth transistor T5 is coupled between the first transistor T1 and the OLED. The emission control signal EMIi supplied from the emission control line Ei controls the turning on and off of the fifth transistor T5.

In more detail, the first electrode of the fifth transistor T5 is coupled to the second electrode of the first transistor T1, and the second electrode of the fifth transistor T5 is coupled to the anode electrode of the OLED. The gate electrode of the fifth transistor T5 is coupled to the emission control line Ei. The fifth transistor T5 is turned off when the voltage level of the emission control signal EMIi supplied from the emission control line Ei is high to insulate the pixel circuit 52 from the OLED and is turned on when the driving current is supplied from the first transistor T1 to the OLED.

The sixth transistor T6 is coupled between the first power source ELVDD and the first transistor T1. The emission control signal EMIi supplied from the emission control line Ei controls the turning on and off of the sixth transistor T6.

In more detail, the first electrode of the sixth transistor T6 is coupled to the first power source ELVDD, and the second electrode of the sixth transistor T6 is coupled to the first electrode of the first transistor T1. The gate electrode of the sixth transistor T6 is coupled to the emission control line Ei. The sixth transistor T6 is turned off when the voltage level of the emission control signal EMIi supplied from the emission control line Ei is high to insulate the first transistor T1 from the first power source ELVDD and is turned on when the voltage level of the emission control signal EMIi is transited to (or transitions to) a low level to couple the first transistor T1 to the first power source ELVDD.

The storage capacitor Cst is coupled between the gate electrode of the first transistor T1 and the first power source ELVDD. The storage capacitor Cst is initialized by the initialization power source Vinit in a period when the previous scan signal SSi-1 is supplied, charges the voltages corresponding to the data signal Vdata and the threshold voltage of the first transistor T1 in a period when the current scan signal SSi is supplied, and maintains the charged voltages in a period when the pixel 50 emits light.

The OLED is coupled between the pixel circuit 52 and the second power source ELVSS to emit light with brightness corresponding to a driving current that flows from the first power source ELVDD to the second power source ELVSS via the pixel circuit 52 and the OLED. The OLED includes organic light emitting layers that emit red, green, and/or blue light components to generate the light components of the corresponding colors.

Figure 3:
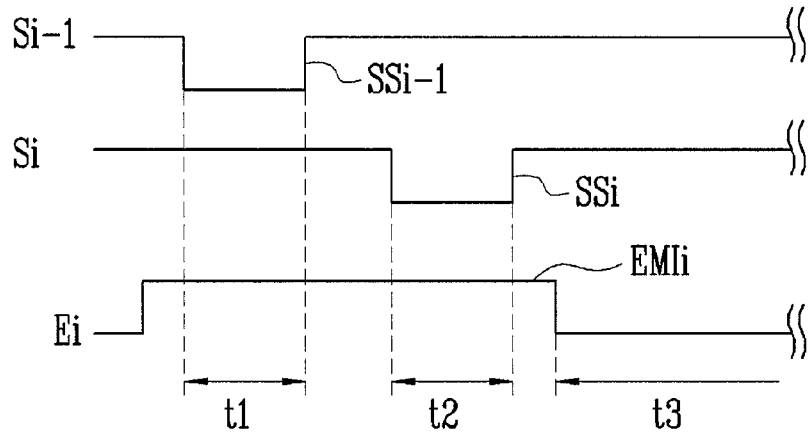
FIG. 3 is a waveform diagram illustrating a method of driving the pixel of FIG. 2.

FIG. 3 is a waveform diagram illustrating a method of driving the pixel of FIG. 2 according to one embodiment of the present invention.

Referring to FIG. 3, the pixel 50 sequentially receives the previous scan signal SSi-1 and the current scan signal SSi in a low level from the previous scan line Si-1 and the current scan line Si respectively and receives the emission control signal EMIi in a high level that overlaps the previous scan signal SSi-1 and the current scan signal SSi from the emission control line Ei.

Here, the emission control signal EMIi maintains the high level voltage at which the fifth transistor T5 and the sixth transistor T6 are turned off in a period when the previous scan signal SSi-1 and the current scan signal SSi are supplied and is transited to (or transitions to) a low level voltage at which the fifth transistor T5 and the sixth transistor T6 are turned on after the supply of the current scan signal SSi is completed.

The pixel 50 receives the first power source ELVDD, the second power source ELVSS, and the initialization power source Vinit from the outside (or an external source) and receives the data signal Vdata from the data line Dj.

The operation of the pixel 50 will be described in more detail. First, in a first period t1 when the low level previous scan signal SSi-1 is supplied to the previous scan line Si-1, the fourth transistor T4 is turned on. Then, the voltage of the initialization power source Vinit is transmitted to the first node N1 so that the voltage of the first node N1 is initialized. Therefore, the voltage stored in the storage capacitor Cst is initialized. That is, the first period t1 is set as a period for initializing the voltage of the first node N1.

Then, in a second period t2 when the low level current scan signal SSi is supplied to the current scan line Si, the second transistor T2 and the third transistor T3 are turned on. When the second transistor T2 and the third transistor T3 are turned on, the data signal Vdata supplied from the data line Dj is transmitted to the first node Ni via the second transistor T2, the first transistor T1, and the third transistor T3. At this time, since the first transistor T1 is diode coupled by the third transistor T3, the threshold voltage of the first transistor T1 is reflected (or transmitted) to the first node N1 together with the data signal Vdata. In this way, a voltage corresponding to the data signal Vdata and the threshold voltage of the first transistor T1 is charged in the storage capacitor Cst.

Then, in a third period t3 when the voltage level of the emission control signal EMIi supplied to the emission control line Ei is transited to the low level, the fifth transistor T5 and the sixth transistor T6 are turned on.

Then, a driving current corresponding to the voltage charged in the storage capacitor Cst is supplied to the OLED through the first transistor T1.

The threshold voltage of the first transistor T1 is offset and the driving current corresponding to the data signal Vdata is supplied to the OLED regardless of the threshold voltage of the first transistor T1. Therefore, the OLED emits light with uniform brightness corresponding to the data signal Vdata regardless of the threshold voltage of the first transistor T1.

The previous scan signal SSi-1 and the current scan signal SSi for driving the pixel 50 are generated by the scan driver 10 illustrated in FIG. 1, and the emission control signal EMIi is generated by the emission control driver 20.

Figure 4:
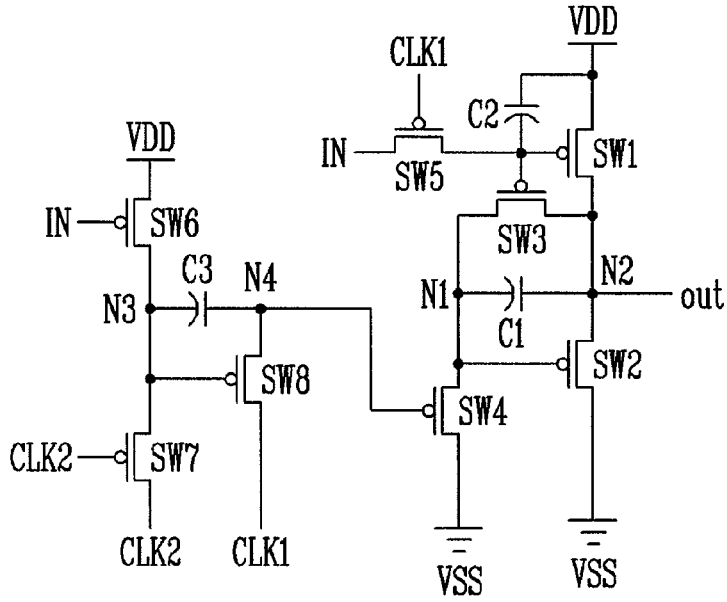
FIG. 4 is a circuit diagram illustrating an example of a shift register included in a scan driver of the organic light emitting display of FIG. 1.
Figure 5:
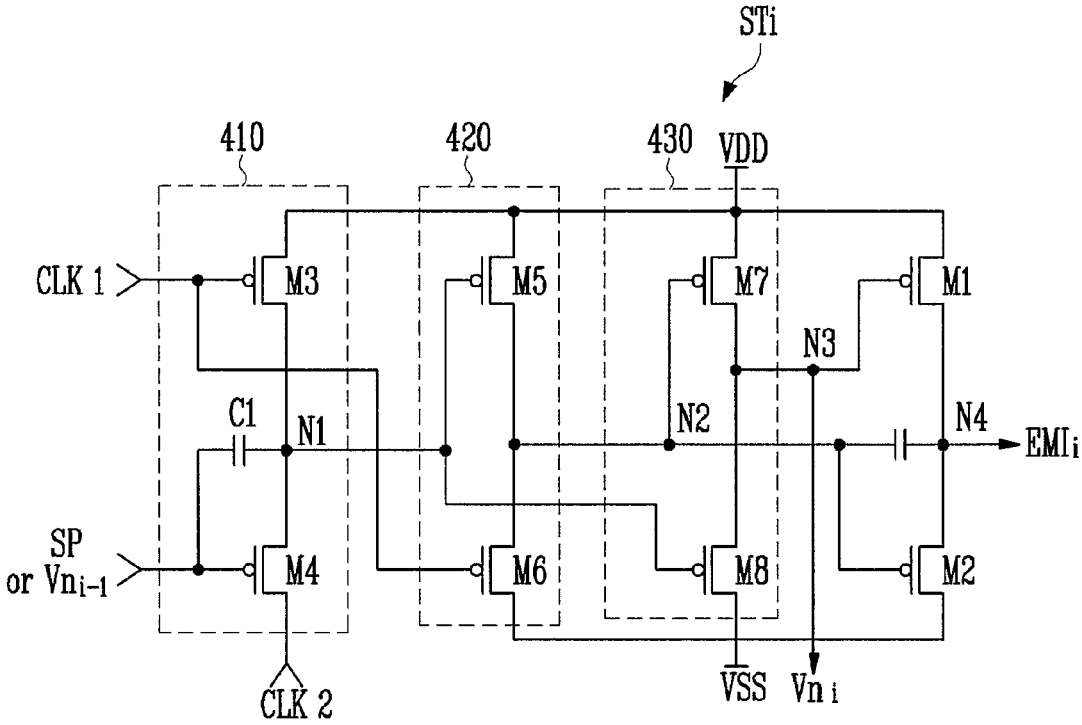
FIG. 5 is a circuit diagram illustrating an example of a shift register included in an emission control driver of the organic light emitting display of FIG. 1.

FIG. 4 is a circuit diagram illustrating an example of a shift register which may be included in the scan driver of FIG. 1 in one embodiment of the present invention. FIG. 5 is a circuit diagram illustrating an example of a shift register which may be included in the emission control driver of FIG. 1. In particular, FIGS. 4 and 5 are circuit diagrams illustrating the structure of the ith stage among a plurality of stages included in the shift register of the scan driver and the shift register of the emission control driver, respectively.

In the stage circuit of the shift register of FIG. 4, the high level voltage of the output signal; that is, the scan signal of the stage, is generated due to (or from) the first power source VDD. The low level voltage of the scan signal is generated due to (or from) the second power source VSS of the shift register.

Here, the first power source VDD and the second power source VSS of the shift register refer to the driving powers of the scan driver including the shift register, which may actually correspond to a gate high level voltage VGH and a gate low level voltage VGL supplied to the scan driver.

Also, in the stage STi circuit of the shift register of FIG. 5, the output signal of the stage STi; that is, the high level voltage of the emission control signal EMIi is generated due to the first power source (or first power) VDD of the emission control driver, and the low level voltage of the emission control signal EMIi is generated due to the second power source (or second power) VSS of the emission control driver.

Here, the emission control driver may be built into the scan driver or may be generated alongside (or separate from) the scan driver. The scan driver and the emission control driver may be driven by the same first and second power sources (or first and second powers) VDD and VSS, that is, the same gate high level voltage VGH and gate low level voltage VGL.

Therefore, in order for the scan driver and the emission control driver to normally drive pixels, the gate high level voltage VGH and the gate low level voltage VGL should be stably supplied to the scan driver and the emission control driver.

However, pads for supplying the gate high level voltage VGH and the gate low level voltage VGL from the outside to the scan driver and/or the emission control driver may be located at an edge of a pad unit and may be susceptible to pressure failure. In addition, when the pressure area of the pad is designed to be reduced (or small) in order to reduce a dead space at the lower end of a panel in which the pad unit is formed, it may be difficult to stably supply the gate high level voltage VGH and the gate low level voltage VGL to the scan driver and/or the emission control driver.

Therefore, embodiments of the present invention include an organic light emitting display designed to stably supply the gate high level voltage VGH and the gate low level voltage VGL for driving the scan driver and/or the emission controller. Detailed description thereof will be described with reference to FIG. 6.

Figure 6:
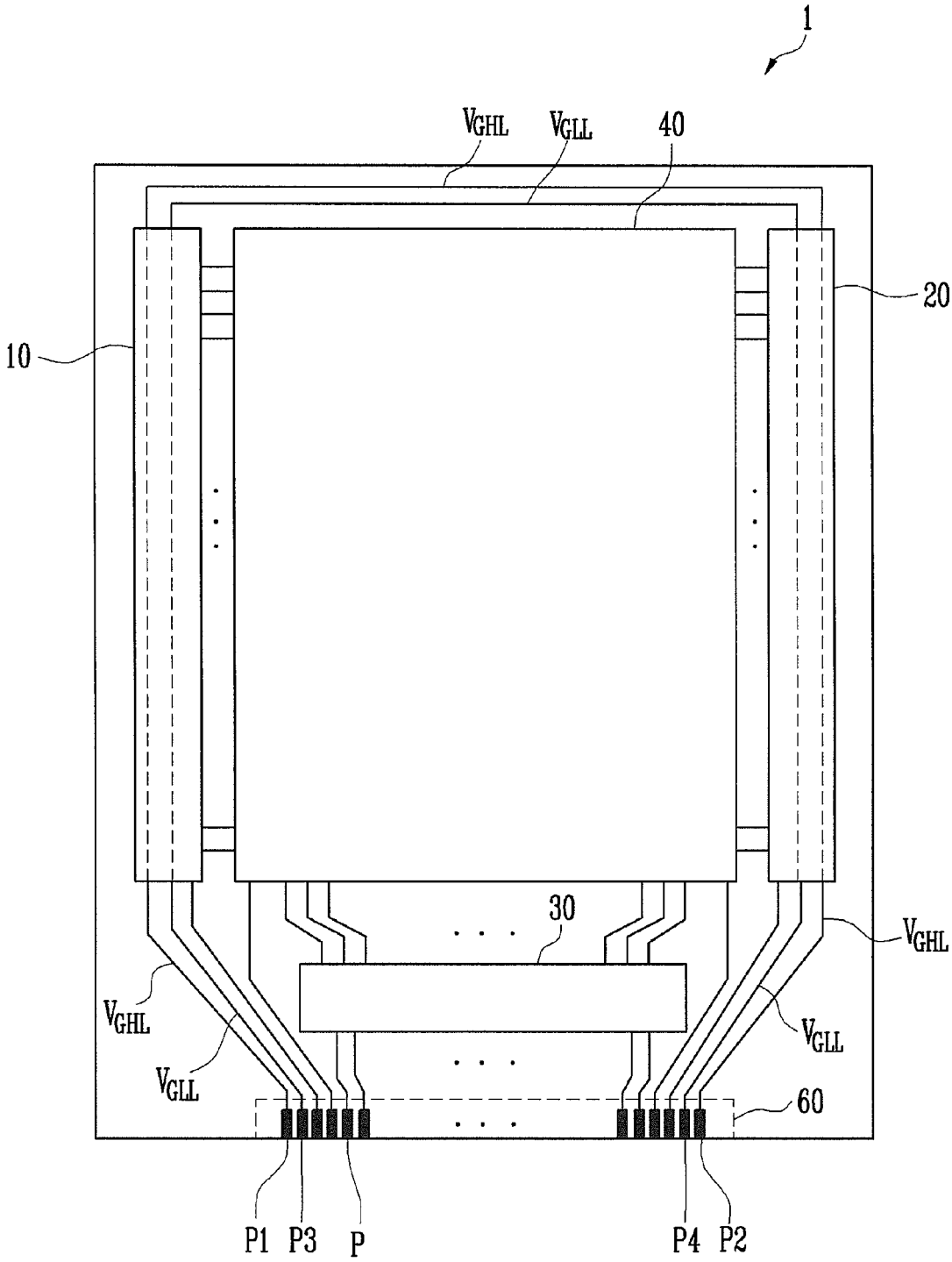
FIG. 6 is a plan view illustrating a panel of an organic light emitting display according to an embodiment of the present invention.

FIG. 6 is a plan view illustrating the panel of an organic light emitting display according to an embodiment of the present invention.

Referring to FIG. 6, the panel 1 of the organic light emitting display according to the embodiment of the present invention includes a display unit 40 located in the center of the panel 1, a scan driver 10 located on one side of the panel 1, an emission control driver 20 located on the panel 1 to face the scan driver 10 based on (or across) the display unit 40, a pad unit 60 located on the other side of the panel 1, and a data driver 30 located between the display unit 40 and the pad unit 60.

In FIG. 6, the scan driver 10 is located on the left of the display unit 40, that is, on the left (or at the left edge) of the panel; and the emission control driver 20 is located on the right of the display unit 40, that is, on the right (or at the right edge) of the panel 1. However, embodiments of the present invention are not limited to the above.

For example, the scan driver 10 may be located on the right (or at the right edge) of the panel 1, and the emission controller 20 may be located on the left (or at the left edge) of the panel 1. That is, the scan driver 10 and the emission control driver 20 may be located at the left or at the right edges (or regions) of the panel 1 with the display unit 40 interposed.

In addition, according to the present embodiment, the scan driver 10 and the emission control driver 20 are separated from each other and are located to face each other based on the display unit 40. However, the scan driver 10 and the emission control driver 20 may be united into one scan driver to be formed at a left edge (or region), a right edge, or both the left and the right edges of the panel 1. In accordance with a pixel structure, the emission control driver 20 may be omitted.

The pad unit 60 may be located at the other edge (or region), for example, at the lower edge of the panel 1 where the scan driver 10 and the emission control driver 20 are not located and includes a plurality of pads P for supplying driving powers and control signals to the panel 1.

The driving powers and the control signals may be supplied to the display unit 40, the scan driver 10, the emission control driver 20, and the data driver 30 through the pads P.

According to embodiments of the present invention, a plurality of pads for supplying the gate high level voltages VGH to the scan driver 10 and the emission control driver 20 and a plurality of pads for supplying the gate low level voltage VGL to the scan driver 10 and the emission control driver 20 are provided.

For example, the pad unit 60 may include first and second pads P1 and P2 for supplying the gate high level voltage VGH to the scan driver 10 and the emission control driver 20, and third and fourth pads P3 and P4 for supplying the gate low level voltage VGL to the scan driver 10 and the emission control driver 20. The first pad P1 and the second pad P2 may be arranged at different edges of the pad unit 60 and the third pad P3 and the fourth pad P4 may be arranged at different edges of the pad unit 60.

In the exemplary embodiment shown in FIG. 6, on the panel 1, a first power source supply line VGHL designed to be coupled from the first pad P1 to the second pad P2 via the scan driver 10 and the emission control driver 20 surrounds the display unit 40, and a second power source supply line VGLL coupled from the third pad P3 to the fourth pad P4 via the scan driver 10 and the emission control driver 20 also surrounds the display unit 40.

That is, the first power source supply line VGHL and the second power source supply line VGLL couple the scan driver 10 and the emission control driver 20 to each other through the upper region (or the region at an upper edge) of the panel 1 that faces (i.e., is located across the display unit 40 from) the pad unit 60.

Therefore, the high level voltages of the scan signal generated by the scan driver 10 and the emission control signal generated by the emission control driver 20 are generated to have the same level due to the same gate high level voltage VGH supplied from the first power source supply line VGHL. The low level voltages of the scan signal and the emission control signal are generated to have the same level due to the same gate low level voltage VGL supplied from the second power source supply line VGLL.

In particular, according to embodiments of the present invention, the gate high level voltage VGH from the outside is not supplied to one (or only one) of the first and second pads P1 and P2 but the same gate high level voltage VGH is supplied to all of the first and second pads P1 and P2.

Therefore, although pressure failure may be generated (or may occur) in one of the first and second pads P1 and P2, the gate high level voltage VGH may be normally supplied to the scan driver 10 and the emission control driver 20 through the other pad.

In addition, since the first and second pads P1 and P2 and the scan driver 10 and the emission control driver 20 are coupled to each other through the first power source supply line VGHL, the same gate high level voltage VGH may be supplied to the scan driver 10 and the emission control driver 20 so that the panel 1 may be stably driven.

In addition, according to embodiments of the present invention, like in the first and second pads P1 and P2, the same gate low level voltage VGL is supplied to the third pad P3 and the fourth pad P4 so that the gate low level voltage VGL of the same level may be normally supplied to the scan driver 10 and the emission control driver 20.

That is, according to embodiments of the present invention, the same gate high level voltage VGH and the same gate low level voltage VGL may be stably supplied to the scan driver 10 and the emission control driver 20.

In order to minimize voltage reduction in the panel 1, the first power source supply line VGHL and the second power source supply line VGLL may be formed of a low resistance material.

For example, the first power source supply line VGHL and the second power source supply line VGLL may be formed in the same layer as and formed of the same material as the source and drain electrodes of the transistors (for example, the transistors provided in the display unit 40, the scan driver 20, and/or the emission control driver 30) formed on the panel 1 or may be formed in the same layer as and formed of the same material as the gate electrodes of the transistors.

In another embodiment, the first power source supply line VGHL and the second power source supply line VGLL are formed of the same material as the source and drain electrodes of the transistors in one region and are formed of the same material as the gate electrodes of the transistors in another region. The first power source supply line VGHL and the second power source supply line VGLL may be formed of the source and drain electrode material or the gate electrode material of the transistors. That is, the first power source supply line VGHL and the second power source supply line VGLL may be freely designed by selecting a low resistance material among the materials used for forming the panel 1.

While aspects of the present invention have been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

a display unit at the center of a panel and comprising a plurality of pixels at crossing regions of scan lines and data lines;

a scan driver for supplying scan signals to the scan lines and on the panel;

a pad unit on the panel and for supplying driving powers and control signals to the display unit and the scan driver, the pad unit comprising first and second pads for supplying a gate high level voltage to the scan driver and third and fourth pads for supplying a gate low level voltage to the scan driver;

a first power source supply line surrounding the display unit and coupling the first pad to the second pad via the scan driver;

a second power source supply line surrounding the display unit and coupling the third pad to the fourth pad via the scan driver; and an emission control driver on the panel and for supplying emission control signals to emission control lines extending in parallel with the scan lines, wherein the first power source supply line surrounding the display unit couples the first pad to the second pad via the scan driver and the emission control driver, and wherein the second power source supply line surrounding the display unit couples the third pad to the fourth pad via the scan driver and the emission control driver.

2. The organic light emitting display of claim 1, wherein the scan driver is configured to generate high level voltages of the scan signals by utilizing the gate high level voltage and to generate low level voltages of the scan signals by utilizing the gate low level voltage, and wherein the emission control driver is configured to generate high level voltages of the emission control signals by utilizing the gate high level voltage and to generate low level voltages of the emission control signals by utilizing the gate low level voltage.

3. The organic light emitting display of claim 1, wherein the scan driver is at a first edge of the panel and the emission control driver is at a second edge of the panel.

4. The organic light emitting display of claim 3, wherein the pad unit is on a lower edge of the panel, and wherein the first power source supply line and the second power source supply line couple the scan driver and the emission control driver together through a region at an upper edge of the panel.

5. The organic light emitting display of claim 1, further comprising a data driver between the display unit and the pad unit and for supplying data signals to the data lines.

6. The organic light emitting display of claim 1, wherein the first pad and the second pad are configured to receive a same gate high level voltage, and wherein the third pad and the fourth pad are configured to receive a same gate low level voltage.

7. The organic light emitting display of claim 1, wherein the first pad and the second pad are at different edges of the pad unit.

8. The organic light emitting display of claim 1, wherein the third pad and the fourth pad are at different edges of the pad unit.

9. The organic light emitting display of claim 1, wherein the first power source supply line and the second power source supply line are in the same layer as and composed of the same material as source and drain electrodes of transistors on the panel.

10. The organic light emitting display of claim 1, wherein the first power source supply line and the second power source supply line are formed in the same layer as and composed of the same material as gate electrodes of transistors on the panel.

11. The organic light emitting display of claim 1, wherein a first portion of the first power source supply line and a first portion of the second power source supply line are in the same layer as and composed of the same material as source and drain electrodes of transistors on the panel and wherein a second portion of the first power source supply line and a second portion of the second power source supply line are in the same layer as and composed of the same material as gate electrodes of the transistors on the panel.

12. The organic light emitting display of claim 1, wherein the scan driver is on a first side of the panel and the pad unit is at a second side of the panel.

13. The organic light emitting display of claim 1, wherein the first power source supply line extends along at least three sides of the display unit.

* * * * *